US006692002B2

(12) United States Patent
Kummer

(10) Patent No.: US 6,692,002 B2
(45) Date of Patent: Feb. 17, 2004

(54) BOARD GAME FOR ENHANCING WORD BUILDING SKILLS

(76) Inventor: Steve Kummer, 18908 La Costa La., Boca Raton, FL (US) 33496

( * ) Notice: Subject to any disclaimer, the term of this patent is extended or adjusted under 35 U.S.C. 154(b) by 0 days.

(21) Appl. No.: 10/224,314

(22) Filed: Aug. 21, 2002

(65) Prior Publication Data

US 2003/0038424 A1 Feb. 27, 2003

Related U.S. Application Data

(60) Provisional application No. 60/314,202, filed on Aug. 23, 2001.

(51) Int. Cl.[7] ..... A63F 9/04
(52) U.S. Cl. ..... 273/272; 273/243; 273/146
(58) Field of Search ..... 273/243, 272, 273/146, 299; 434/170, 171

(56) References Cited

U.S. PATENT DOCUMENTS

| | | | | |
|---|---|---|---|---|
| 1,034,633 A | | 8/1912 | Mansfield | |
| 1,203,473 A | * | 10/1916 | Branch | 273/272 |
| 2,070,608 A | * | 2/1937 | Mitchell | 273/272 |
| 4,055,348 A | | 10/1977 | Marzoni, Jr. | |
| 4,592,553 A | * | 6/1986 | Mammen et al. | 273/240 |
| 4,877,254 A | | 10/1989 | Yuscavage | |
| 5,167,503 A | * | 12/1992 | Jordan | 434/128 |
| 5,316,482 A | | 5/1994 | Bryson | |
| 5,511,792 A | | 4/1996 | Simmons et al. | |
| 5,558,328 A | | 9/1996 | Krantz | |
| 5,743,740 A | | 4/1998 | Visser et al. | |
| 5,876,211 A | | 3/1999 | Schmoyer et al. | |
| 6,367,798 B1 | * | 4/2002 | Lawal | 273/272 |

* cited by examiner

*Primary Examiner*—William M. Pierce
(74) *Attorney, Agent, or Firm*—Hoffman, Wasson & Gitler

(57) ABSTRACT

A board game for enhancing the spelling skills of each of several players of different ages. The board game comprises a board with a start position, a finish position, with a lengthy path defined by discrete spaces extending therebetween in a serpentine fashion. The path also includes intersecting circles and a by pass leg. Each player receives a game pawn, or marker, and advances same along the spaces on the pathway by rolling six dice, with a different letter on each face. The extent of movement is governed by the number of letters in each word that the player builds from letters on the exposed faces of the dice, augmented by an element of chance introduced by Pick-a-Card cards and/or Keep-a-Letter for Life cards. The player receives one of these cards when his pawn lands on a designated space in the pathway. Additionally, movement controlling spaces in the path come into play when a pawn lands directly on one of these spaces. The board game thus combines vocabulary skills, good luck, and strategic planning, to maintain the interest of each player over an extended period of time.

13 Claims, 4 Drawing Sheets

BOARD GAME FOR ENHANCING WORD BUILDING SKILLS

The present application is based upon provisional patent application Serial No. 60/314,202, filed Aug. 23, 2001, and entitled "Board Game for Word Building Skills".

BACKGROUND OF THE INVENTION

1. Field of the Invention

The instant invention relates generally to board games wherein movement along a pathway, defined on a playing board, is controlled by rolling dice for each of several players. More particularly, the instant invention pertains to a board game wherein spelling skills are enhanced, by building words comprised of individual letters appearing on the faces of several unique dice.

2. Description of the Prior Art

Diverse games have been devised to increase the word building, and/or spelling skills, for players of all ages. To illustrate, U.S. Pat. No. 5,588,328, Krantz, discloses a word game wherein words are formed by the arrangement of letters of the alphabet, appearing on the faces of a set of dice. The set of dice usually consists of twelve dice with six faces apiece.

Another word building game is shown in U.S. Pat. No. 4,055,348, Marzoni, which employs five dice with a particular distribution of vowels and consonants on the dice.

U.S. Pat. No. 1,034,633, Mansfield, discloses a board game wherein movement of each player around the board is controlled by five dice, or cubes, 1, 2, 3, 4, 5, bearing different letters on each face of the dice. When a player spells a word, he is able to move one of his markers (or scholars) one space for each letter used in constructing the word; note page 1, lines 96–108. Each player attempts to move from his "home" position, in a corner of the rectangular game board, along road 11 toward schoolhouse 7, around the school house, and then return "home"; the game simulates a spelling bee.

Yet another board game, that enhances one's vocabulary, is shown in U.S. Pat. No. 5,316,482, Bryson. The board game disclosed in the Bryson patent consists of a game board (12), vowel cube playing pieces (28; 30) playing pieces, a die (32), a star cube (36), free pass tokens (38), point tokens (40), scoring method cards (42), vocabulary cards (44), playing position cards (58), a timer (60), pencils (62), pads of paper (64), and storage files (66) for the vocabulary cards. The object of the game is for a player to accumulate as many points as possible, to beat the opponents, by knowledge of vocabulary words, stopping on the player's own vowel space (on the perimeter of the game board) by the roll of the die, and rolling a star on the star cube.

The word games noted above may be too challenging for young children (to illustrate, note that Bryson relies upon six hundred alphabetical vocabulary cards, as noted in column 6, lines 34–64), and may not succeed in generating interest in word building.

Thus, the quest for a board game, that will enhance word building skills, in a pleasant environment, for players of different ages, and skill levels, remains unfulfilled. Applicant's unique game strives to fill such void through the integration of consonants and vowels on the exposed faces of a set of several interrelated dice, plus two distinct decks of cards, identified as Pick A Card and Letter for Life cards, which introduce elements of luck and strategy into the game.

SUMMARY OF THE INVENTION

The primary object of the instant invention is to provide a board game, that combines word-building skills, with good fortune, and strategy, to produce an entertaining and educational game that will retain the interest of several players, for an extended period of time.

Another object is to provide a board game that is challenging enough to appeal to two to four players, ranging in age from six years to adult, so that the board game may be played as "family" entertainment.

Another object is to provide a board game with an aesthetically pleasing game board, decorated with interesting graphics, for appeal to game enthusiasts of all ages.

Yet another object is to provide a board game comprising a game board, four pawns or markers, a deck of "Pick A Card" cards, a deck of "Keep a Letter" for Life cards, six dice with a different letter on each face, and a sheet of instructions. The components of the board game are stored in a decorated paperboard box, with the tradename THE GREAT WORD RACE, prominently displayed thereon. The board game is capable of being manufactured, assembled, distributed, and ultimately sold, at a competitive price, in line with other established board games.

Additionally, it is another object to provide a board game relying upon a plurality of dice to enable each player to build words from the individual letters displayed on the exposed faces of the dice, after the player has rolled or thrown same. The plurality of dice consist of six dice, and the six dice include a pre-selected, unique distribution of consonants and vowels.

The distribution of letters, on each die, is different, and has been selected to maximize the educational, and amusement, values associated with, and attributable to, applicant's board game. Other objects and advantages will occur to the skilled artisan when the ensuing specification is construed in harmony with the appended drawings.

BRIEF DESCRIPTION OF THE INVENTION

DETAILED DESCRIPTION OF PREFERRED EMBODIMENT

Figure 1:
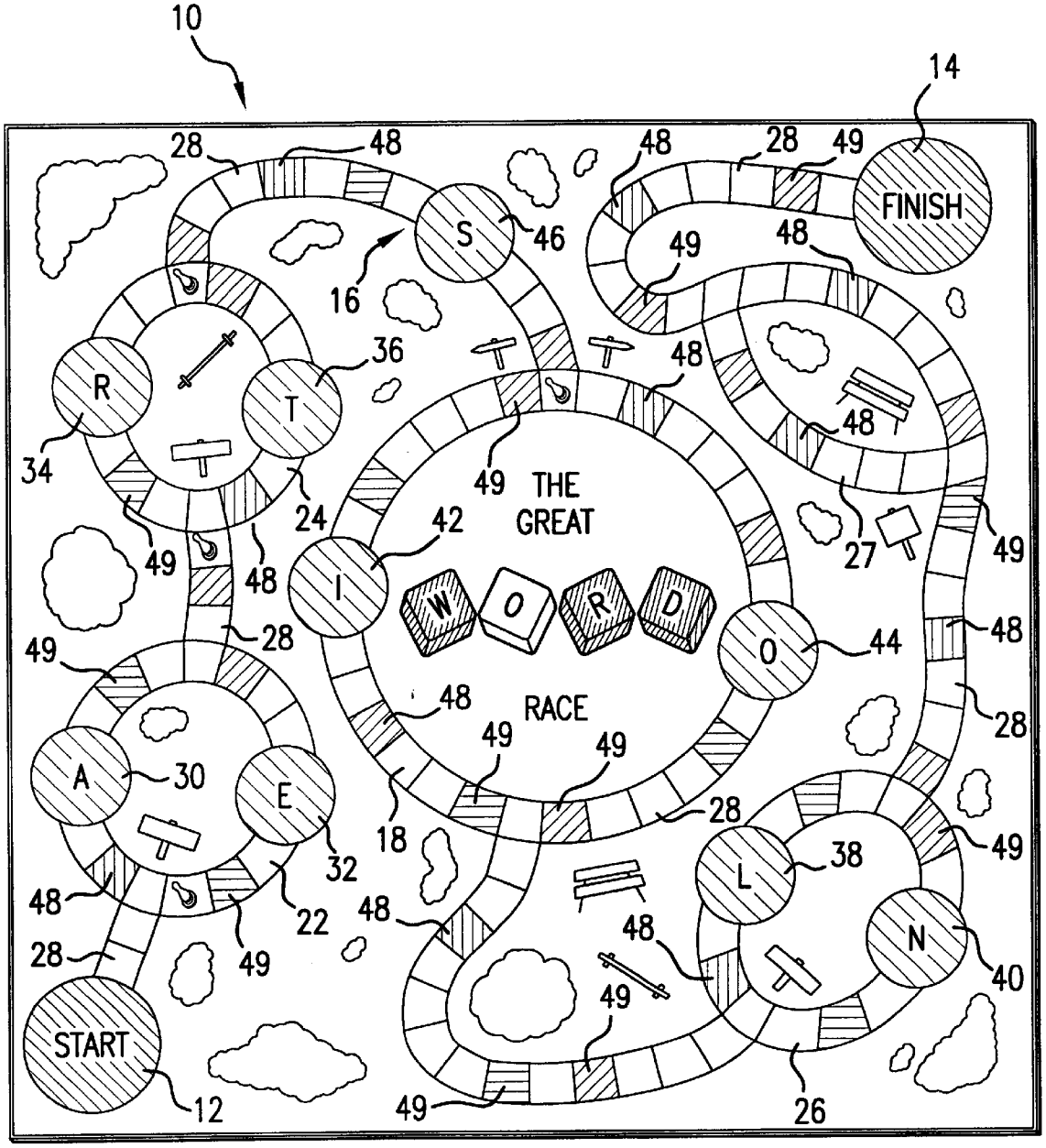
FIG. 1 is a top plan view of the game board constructed in accordance with the principles of the present invention.

A board game, constructed in accordance with the principles of applicant's invention, is shown in FIGS. 1–5. The board game is played on a flat surface, such as a table or the floor, and the unique game board, 10, is shown in FIG. 1.

A circular "start" position 12 is defined in the lower left hand corner of the rectangular game board, and a circular "finish" position 14 is defined in the upper right hand corner of the game board. A serpentine path, indicated generally by reference numeral 16, extends between the "start" position and the "finish" position, with a centrally located great circle 18 incorporated within path 16. The name of the game, THE GREAT WORD RACE, appears in interior of circle 18.

Three smaller circles 22, 24 and 26 are also incorporated into path 16, and an offset leg 27 by-passes the path shortly before reaching finish position 14.

A plurality of discrete spaces 28 divide path 16 into individual squares. Circular stations 30, 32 are situated on opposite sides of circle 22, circular stations 34, 36 are situated on opposite sides of circle 24, and circular stations 38, 40 are situated on opposite sides of circle 26. Circular stations 42, 44 are located on opposites sides of great circle 18, and a circular station 46 is situated in the pathway between circle 24 and great circle 18. A total of nine circular stations are provided in path 16, as it traverses game board 10. Each circular station contains specific instructions regarding a particular letter, such as "Keep an A for life", "Keep an E for life", "Keep an I for life", etc. The circular stations pertaining to a vowel may be highlighted in one color, such as yellow, while the circular stations pertaining to a consonant may be highlighted in a different color, such as blue.

The majority of spaces 28 are unmarked, but specifically marked spaces 48 and 49 are distributed along path 16. Spaces 48, which are usually colored blue, total 11 in number; spaces 48 bear the legend "Pick A Card", and are operatively associated with a unique deck of cards, printed for the instant board game.

Spaces 49 are identified by diverse colors, such as green, pink and gray, to contrast with the blue color of spaces 48. Spaces 49 bear legends which regulate the movement of the pawn of the player landing directly thereon. The legends include "move 2 more spaces", "double your spaces", and "move back 2 spaces". There are 26 spaces 49 distributed along path 16, so that the chances of landing on one of the move-regulating spaces 49 exceeds the chances of landing on one of the spaces 48 associated with the Pick-A-Card deck, or stack, of cards.

Figure 2:
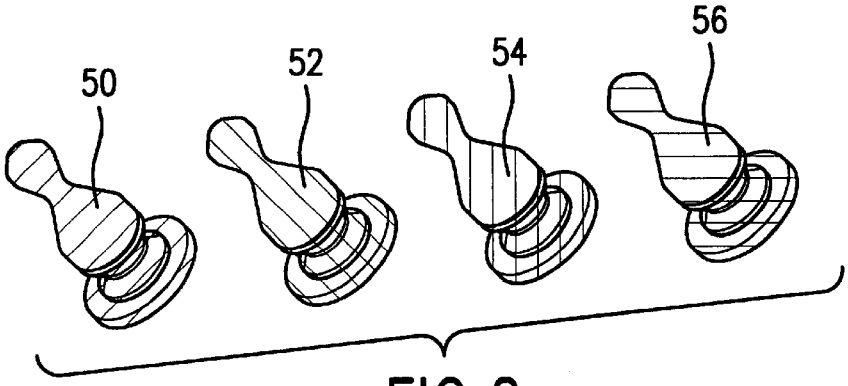
FIG. 2 is a perspective view of the markers that are advanced along the game board of FIG. 1.

FIG. 2 shows the pawns 50, 52, 54 and 56 that are advanced along spaces 28 on path 16 of game board 10, when the player is able to construct a word from the exposed surfaces of the six dice, plus other factors, to be described hereinafter. Each pawn is distinguishable by its color, or shape, or some other unique feature. In the preferred embodiment of the instant board game, each pawn is of a different color, such as red, blue, yellow and green. The game is suitable for play by a maximum of four players, and each player advances his, or her, own pawn exclusively.

Figure 3:
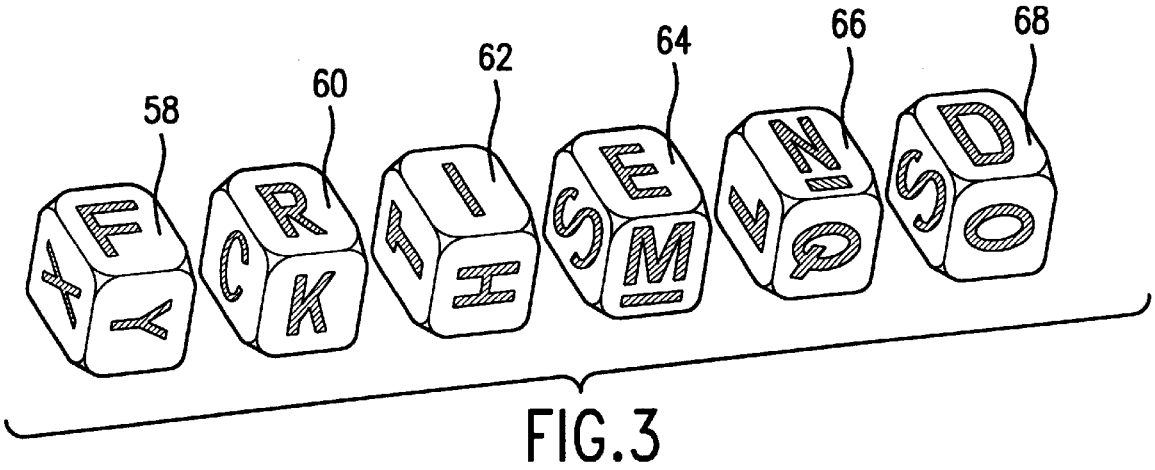
FIG. 3 is a perspective view of the six dice, with a letter on each face for controlling the movement of the markers on the game board of FIG. 1.

FIG. 3 shows the six dice 58, 60, 62, 64, 66, and 68 that are rolled by each player, on every turn. Each of the six faces of each die, or cube, has a single letter imprinted thereon. The distribution of the letters about the several faces of the six dice has been carefully chosen, so that the distribution contributes to the enjoyment of the game. Individual or distinct vowels and consonants are used on the face of the dice, and each letter of the alphabet occurs at least once. The actual distribution of the letters, on the six sides of each die, or cube, is indicated between.

Die 58—U Y <u>Z</u> X J F

Die 60—O A C K T R

Die 62—U I <u>N</u> T V H

Die 64—A E S P B <u>M</u>

Die 66—E I Q L R <u>N</u>

Die 68—E O S <u>W</u> D G

The unique distribution of letters, on the set of six dice, adheres to the following guidelines:

a) Each letter of the alphabet occurs at least once;

b) Most vowels occur twice, Y occurs once and E occurs three times (A-2, E-3, I-2, O-2, U-2, Y-1) ;

c) Highly used consonants occur twice (N-2, R-2, S-2, T-2)

d) Each die has two vowels;

e) The letters Q and U are not on the same die; and f) Die 58 has less frequently used letters so that the player does not get more than one of these letters on each turn.

Figure 4:
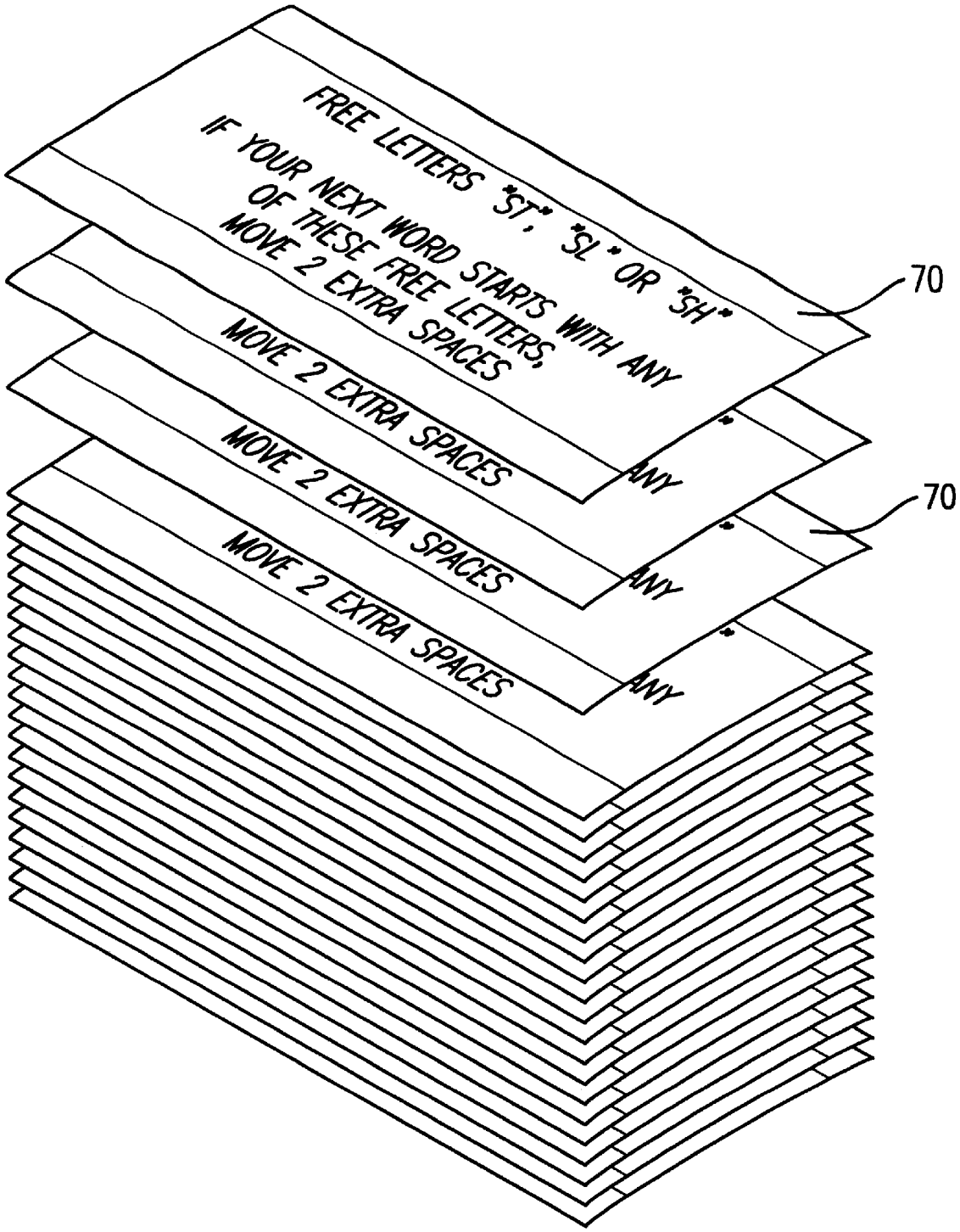
FIG. 4 shows a first stack of cards that are designated as a "Pick A Card" deck.

FIG. 4 shows a stack of cards 70 that may bear the designation "Pick A Card". One card 70 is chosen from the stack by a player advancing his pawn to rest on one of the colored squares 48 distributed along path 16. Such squares are imprinted with the direction, Pick a Card, and direct the player to select the top card in deck 70. Each card has specific instructions imprinted thereon, such as pairs of free letters, ST, SL, or SH, and additional spaces, which may be used on the player's next move.

Figure 5:
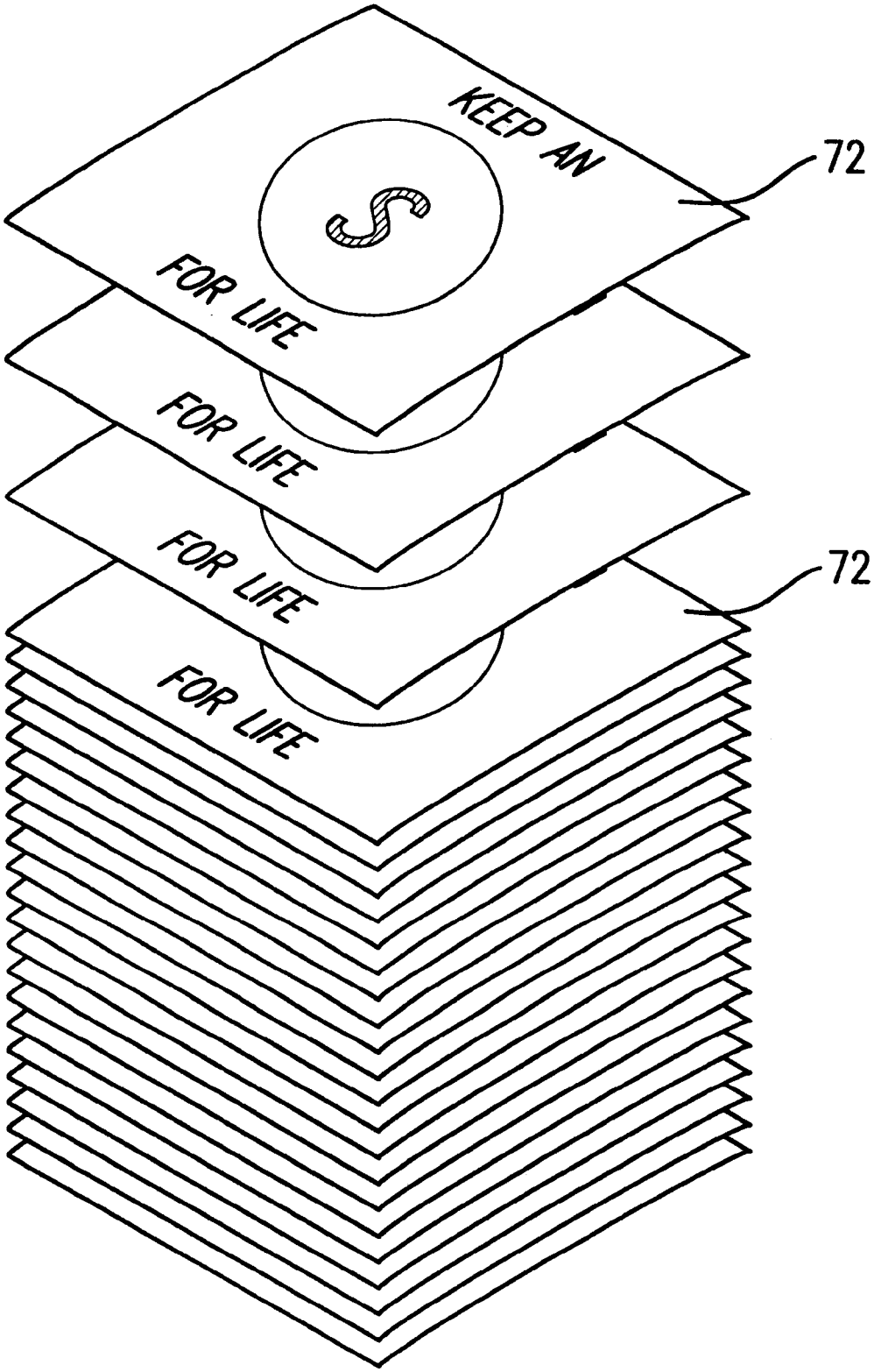
FIG. 5 shows a different stack of cards that are designated as the "Letter for Life" deck.

FIG. 5 shows a second, different stack of cards 72 that may bear the designation "Keep a Letter" for Life, and refer to a specific letter. Cards 72 are retained by the individual player who receives same by landing on one of the nine circular stations 30, 32; 34, 36; 38, 40; 42; 44; and 46 distributed along path 16.

The letter imprinted thereon may be used, on every turn thereafter, to facilitate building a word and to increase the length of such word. Game board 10 contains nine circular stations associated with the Keep A Letter for Life cards 72. However, a greater number of Pick-a-Card spaces are distributed along path 16 and 30 Pick-a-Card cards 70 are found in the first deck of cards, shown in FIG. 4. Thirty-six cards, including nine unique cards, corresponding to the nine circular stations on the game board, are found in the deck of cards 72 designated as "Keep a Letter" for Life cards, and shown in FIG. 5.

INSTRUCTIONS

The board game is played according to the following rules. Each player, and the game is suitable for 2, 3 or 4 players, picks one of the distinctive pawns 50, 52, 54 and 56. All of the pawns are placed on the start position 12 on the game board 10. All players roll the same one of the six dice 58, 60, 62, 64, 66 and 68, and the player obtaining the lowest letter goes first; player rotation is clockwise. Each turn is initiated by throwing, or rolling, all six dice; words are built from the letters shown on the exposed face of each die. The letters shown on the exposed faces of the six dice may be augmented by any Letter for Life card 72 selected from the appropriate deck (shown in FIG. 5), as well as by following the instructions on the Pick-A-Card card 70 selected from the appropriate deck (shown in FIG. 4). Cards 70 and 72 are earned when the player advances his pawn to rest directly upon one of the circular stations, or colored squares, located within path 16.

Each player moves his pawn the number of spaces 28 corresponding to the number of letters in the word he has built, plus extra spaces from a Pick A Card card, if earned; for example, if the player builds CAT, he is entitled to move three spaces. If the pawn of another player is already resting on such space, the player is blocked and he can not move onto such space, and, must try to spell another word. Similarly, if the player can not build a word from the letters on the exposed faces of the six dice, augmented by any Pick A Card or Letter for Life card that he has earned, his turn is at an end, and the next player proceeds to roll the dice. Each player takes a turn, and advances his pawn, until all players reach finish position 14; however, the first player to reach the finish position is deemed the winner.

In addition to the skill component of the game, good fortune comes into play when the player lands on one of the blue squares 48 operatively associated with the Pick-A-Card deck or stack 70, and the two letter combinations usually found on such cards are available to the player, on the next turn. A few of the Pick A Card cards 70 only provide additional spaces for the player to move, and a few require the player to spell an insect, animal, etc. Good fortune also comes into play when the player lands directly on one of the nine circular stations operatively associated with the Keep-A-Letter for Life deck, or stack 72; each card bears a vowel (A, E, I, O) or a consonant (L, N, R, S or T). Good fortune also comes into play when the player lands directly on one of the several colored spaces 49, that regulate the movement of the player's pawn, e.g., "double your spaces", "move 2 more spaces", or "move back 2 spaces".

The strategic aspect of the game revolves around decisions of this nature—should a player collect a Letter for Life card 72, double his spaces in accordance with directions imprinted on spaces 49, or Pick A Card from deck 70 and follow its instructions? Strategy also comes into play when one determines the direction of movement (clockwise or counter-clockwise) around smaller circles 22, 24 and 26, and around great circle 18, since spaces 48, 49 are distributed asymmetrically about path 16. The same strategic consideration applies to by-pass leg 27 as the player tries to reach finish position 14. Also, since the circular stations 30–44 are asymmetrically distributed within the small circles 22, 24, 26, the player must decide which direction to move to maximize his chances of earning one of the desirable, or helpful, Letter for Life cards 72.

Thus, the instant board game combines skill in word building or vocabulary, with elements of good fortune, and strategy, to provide an educational experience, of an enjoyable, yet informative nature. The game is suitable for 2–4 players of different ages, from six to adult.

Various modifications and revisions to the board game will occur to the skilled artisan. Consequently, the appended claims should be broadly construed, consistent with the spirit and scope of the invention, and should not be limited to their exact, literal terms.

I claim:

1. A board game for enhancing the spelling skills of several players, said board game comprising:

a) a game board including a start position, a finish position, a path extending between said start and finish position, b) said path being divided into discrete spaces, c) said path between the start and finish positions is serpentine in shape, d) a large circle comprised of several discrete spaces is incorporated into said path intermediate the start and finish positions, e) a plurality of dice with a letter of the alphabet appearing on each face of each die, f) each letter of the alphabet appearing, at least once, on the plurality of dice, g) the plurality of dice being simultaneously thrown so that each die presents an exposed face, h) a plurality of pawns, one pawn reserved for each player, and i) the number of spaces advanced, by the pawn of each player, on each turn, being governed by the number of letters, on the exposed dice, that are combined to form an acceptable word by the player.

2. The board game as defined in claim 1, wherein the plurality of dice equal six in number.

3. The board game as defined in claim 2, wherein each die has two vowels.

4. The board game as defined in claim 3, wherein the letters Q and U do not appear on the same die in the plurality of dice.

5. The board game as defined in claim 2, wherein several circular stations are incorporated into said path at spaced intervals, said circular stations bearing printed instructions for the player whose pawn lands thereon to follow.

6. The board game as defined in claim 5, wherein a first deck of cards, with pairs of letters, and/or words to be spelled, and/or extra spaces to move, imprinted thereon, is operatively associated with said colored spaces, the pairs of letters facilitating the building of words in conjunction with the letters appearing on the exposed faces of the plurality of dice, and providing extra spaces.

7. The board game as defined in claim 6, wherein said colored squares are blue.

8. The board game as defined in claim 5, wherein a second deck of cards, with individual letters imprinted thereon, is operatively associated with said circular stations, the individual letters facilitating the building of words in conjunction with the letters on the exposed faces of the plurality of dice.

9. The board game as defined in claim 2, wherein several colored spaces are incorporated into said path at spaced intervals, said colored spaces bearing printed instructions for the player whose pawn lands thereon to follow.

10. The board game as defined in claim 2, wherein several different colored spaces are incorporated into said path at spaced intervals, said spaces controlling the movement of the pawn of the player that lands directly thereon.

11. The board game as defined in claim 10, wherein the different colored spaces may appear in any color other than blue.

12. The board game as defined in claim 2, wherein several smaller circles are incorporated into said path in addition to said large circle, said smaller circles comprising fewer discrete spaces.

13. The board game as defined in claim 2, wherein a by-pass leg is incorporated into said path to provide an alternate route approaching the finish position.

* * * * *